United States Patent [19]

Guegan

[11] 4,033,546

[45] July 5, 1977

[54] SHOCK ABSORBER PAD OF MOLDED FIBERS FOR THE DROP CASTING OF INGOTS

[76] Inventor: Yves Guegan, 28 Rue Guersant, Paris 17eme, France

[22] Filed: Sept. 12, 1975

[21] Appl. No.: 612,739

[30] Foreign Application Priority Data

Sept. 16, 1974 France ..... 74.31234

[52] U.S. Cl. ..... 249/174; 249/206

[51] Int. Cl.[2] ..... B22D 7/12

[58] Field of Search ..... 249/204, 206, 174; 229/15, 2.5 EC

[56] References Cited

UNITED STATES PATENTS

| | | | |
|---|---|---|---|
| 2,997,196 | 8/1961 | Emery | 229/2.5 EC X |
| 3,120,901 | 2/1964 | Boyd | 229/2.5 EC X |
| 3,375,966 | 4/1968 | Crabtree | 229/2.5 EC |
| 3,451,577 | 6/1969 | Nurick | 229/2.5 EC X |

FOREIGN PATENTS OR APPLICATIONS

| | | | |
|---|---|---|---|
| 523,595 | 4/1956 | Canada | 249/206 |
| 785,914 | 11/1957 | United Kingdom | 229/2.5 EC |

*Primary Examiner*—Robert D. Baldwin
*Attorney, Agent, or Firm*—Young & Thompson

[57] ABSTRACT

A shock absorber pad of molded fibers for the drop casting of ingots, comprising a plate of molded fibers having an assembly of truncated cups disposed in files and rows connected by thick webs along their upper edges. The webs are perforated between the cups and have concave cylindrical ribs for stiffening purposes. The cups and ribs in one file or row are so dimensioned as to nest into the cups and ribs of the opposite edge of an adjacent pad. The bottoms of the cups can be solid or perforate.

3 Claims, 2 Drawing Figures

SHOCK ABSORBER PAD OF MOLDED FIBERS FOR THE DROP CASTING OF INGOTS

Figure 1:
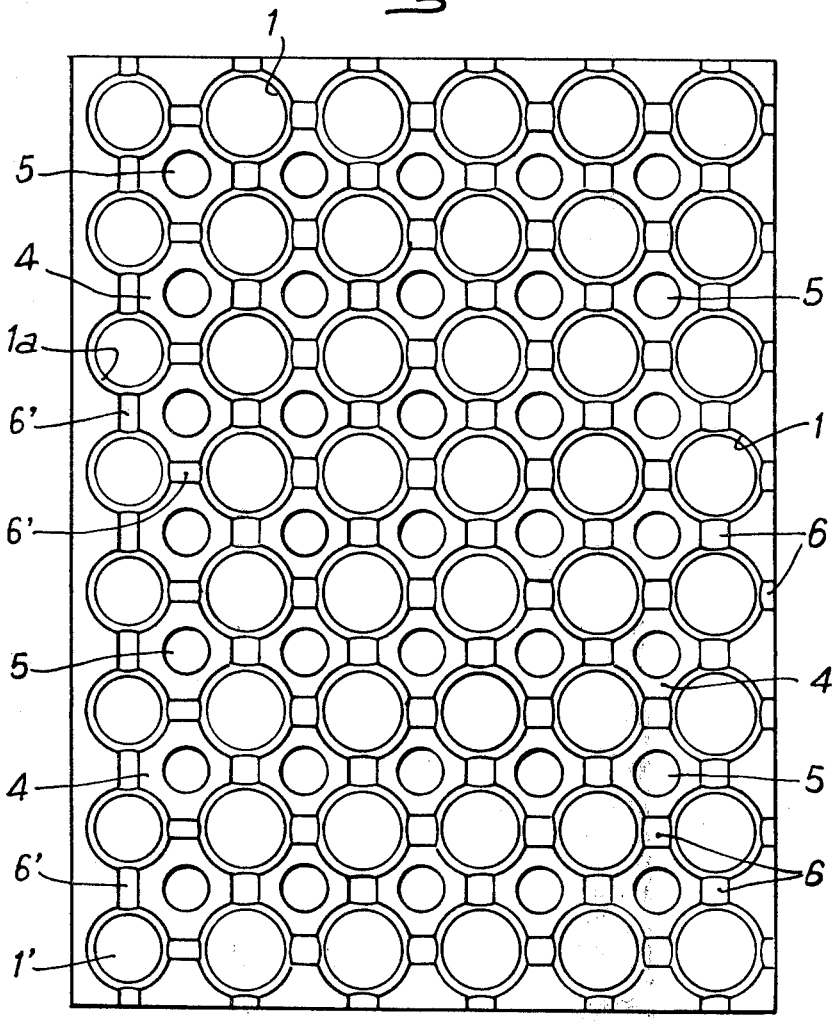

The present invention concerns shock absorber pads for the drop casting of ingots. During this drop casting of ingots, the molten metal which falls from a great height onto the bottom of the ingot mold splashes the walls of said mold on which it solidifies, giving rise to surface defects on the ingots, called cold drops. To surmount this problem, the usual technique is to place on the bottom of the ingot molds pads, the main purpose of which is to avoid this phenomenon of the cold drop, that is to say, to prevent the molten metal drops, which rebound from the bottom, from striking the walls of the ingot mold. These pads are substantially formed by networks of vertical walls, particularly by corrugated cardboard rolled into a spiral or by honeycomb networks of cardboard or molded fibers. The problem raised by these pads is their useful life, that is to say, the time for which they keep their shape during the course of casting. To increase this period, attempts have been made to make the material constituting them more fireproof in various ways, but no attempt has ever been made to provide these pads with a shape or construction increasing the duration of this useful life.

Another problem arising in the drop casting of steel is the erosion on the bottom of the ingot mold. Pads having parallel vertical walls offer practically no protection to the bottom against this erosion. It is also sometimes an advantage to be able to position on the bottom of the ingot mold, at the same time as the pad, a siderurgical agent such as a reducing agent, a formative agent of scoria, a cover and so on and to ensure regular distribution of this agent over the surface of the liquid metal, also causing this agent to rise at the same time as the level of the molten metal.

An object of the present invention is to surmount these disadvantages and to solve the above problems concerning shock absorber pads for ingot molds.

Another object of the present invention is to provide a shock absorber pad of molded fibers for the drop casting of ingots, which will be relatively simple and inexpensive to manufacture, easy to emplace, and rugged and durable in use.

Briefly, the present invention achieves the above objects, by providing a shock absorber pad of molded fibers for the drop casting of ingots, characterized in that it is formed by a plate of molded fibers comprising an assembly of cups disposed in files and rows connected together by a thick web uniting their upper edges, this web comprising perforations in the part between the cups.

The cups naturally have a frusto-conical or truncated pyramid shape, like all objects of molded fibers, in order to permit removal from the mold. The cross section thereof is preferably circular but it could be polygonal. The bottoms of the cups preferably are solid, but the bottoms of at least some of them could be perforated.

By means of the shock absorber pad of the present invention, erosion of the bottoms of the ingot mold is reduced by the thickness of the molded fibers forming the bottom of the cups and, if desired, by a layer of siderurgical agent disposed in the cups. The inclined walls of the cups avoid, like the usual vertical walls of the pads, the phenomenon of the cold drops. The thick web connecting the edges of the cups is above the layer of molten metal and offers longer resistance to combustion, thus ensuring maintenance of the shape of the pad, at least in its peripheral portions, practically almost until the ingot mold is half full. The perforations in the web allow the escape of gases during the casting and avoid disturbance due to the piston effect when the pad is positioned in the ingot mold. The positioning of the pad in the mold is very simple and it is possible to fill, in advance, all or some of the cups with a siderurgical agent.

The pads can be stacked in close formation thus facilitating handling and storage. In order to obtain larger pads for large ingot molds, the cups of one of the files or rows on one of the edges of the pad are, according to a feature of the invention, dimensioned so as to fit in the cups of the file or row of the other edge, thus making it possible to assemble two pads in the form of a unit.

Figure 2:
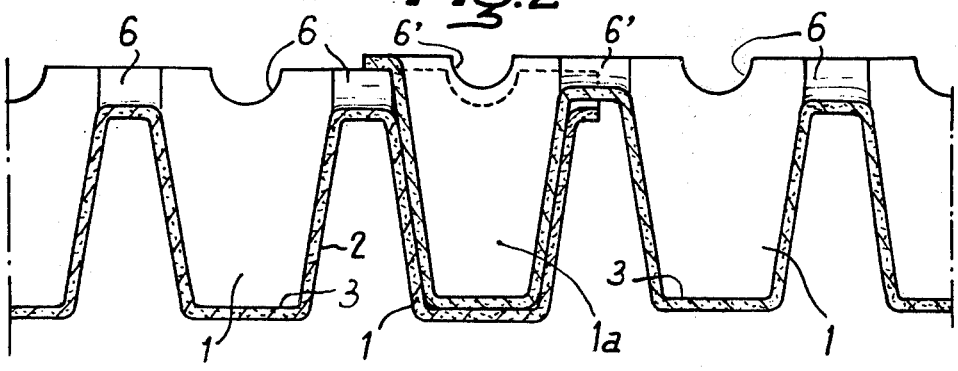

The invention will be more clearly understood by reading the description of an embodiment hereinafter with reference to the accompanying drawing, in which:

FIG. 1 is a plan view of a shock absorber pad for an ingot mold according to the present invention; and FIG. 2 is a view in enlarged cross section, on the axis of the cups, of the edges of two assembled pads.

The shock absorber pad is constructed according to the known molded fiber technique, that is to say by molding by filtration through a screen constituting the mold of a suspension of organic and/or mineral fibers which may contain bonding agents and various charges, in particular, in the present case, of combustion retarding agents, or substances having a siderurgical action.

The molded plate shown, comprises eight rows of six cups 1 with truncated walls 2 and a solid bottom 3. The cups 4 are connected along their upper edges by a web 4 which has, on the vertical axial planes of the cups, semi-cylindrical concave ribs 6 intended to increase rigidity. In each plane portion of the web a perforation 5 is located between four adjacent cups.

The eight cups 1*a* which are located along one of the edges, have a smaller diameter and width so as to engage in the cups 1 located along the opposite edge of another pad until the covers are supported one against the other. Similarly the semi-cylindrical concave ribs 6' which terminate in these cups also have smaller diameters so as to engage in the concave ribs 6 ending in the cups 1 along the opposite edge.

From a consideration of the foregoing disclosure, therefore, it will be evident that the initially recited objects of the present invention have been achieved.

Although the present invention has been described and illustrated in connection with a preferred embodiment, it is to be understood that modifications and variations may be resorted to without departing from the spirit of the invention, as those skilled in this art will readily understand. For example, some of the bottoms 3 may be perforated. This and other modifications and variations are considered to be within the purview and scope of the invention as defined by the appended claims.

I claim:

1. In combination with an ingot mold for the drop casting of ingots a shock absorber pad of molded fibers constituted by a plate of molded fibers insertable in said ingot mold, said plate comprising an assembly of cups disposed in files and rows connected by a flat thick web uniting their upper edes, said web having perforations therethrough between the edges of said cups.

2. In combination with an ingot mold for the drop casting of ingots a shock absorber pad of molded fibers constituted by a plate of molded fibers insertable in said ingot mold, said plate comprising an assembly of cups disposed in files and rows connected by a flat thick web uniting their upper edges, said web having perforations therethrough between the edges of said cups and semi-cylindrical valleys in the upper surface of said web interconnecting the cups in said files and rows.

3. A shock absorber pad of molded fibers for the drop casting of ingots constituted by a plate of molded fibers, said plate comprising an assembly of cups disposed in files and rows connected by a flat thick web uniting their upper edges, said web having perforations therethrough between the edges of said cups and semi-cylindrical valleys in the upper surface of said web interconnecting the cups in said files and rows, the cups of one of the files or rows on one of the edges of the pad having a smaller diameter and width than the cups of the file or row of the opposite edge of the pad and the semi-cylindrical valleys in said web interconnecting the cups of said one file or row having a smaller diameter than the valleys interconnecting the cups of said opposite edge file or row, whereby said smaller cups and valleys along said one edge of one said pad can nest in the cups and valleys along said opposite edge of an adjacent said pad.

* * * * *